US010030830B2

(12) United States Patent
Krotseng et al.

(10) Patent No.: US 10,030,830 B2
(45) Date of Patent: Jul. 24, 2018

(54) DIFFUSER FOR LUMINAIRE

(71) Applicant: Focal Point, LLC, Chicago, IL (US)

(72) Inventors: Stephen Krotseng, Chicago, IL (US); Casey Chung, Chicago, IL (US)

(73) Assignee: Focal Point, LLC, Chicago, IL (US)

( * ) Notice: Subject to any disclaimer, the term of this patent is extended or adjusted under 35 U.S.C. 154(b) by 209 days.

(21) Appl. No.: 14/706,730

(22) Filed: May 7, 2015

(65) Prior Publication Data

US 2016/0327232 A1 Nov. 10, 2016

(51) Int. Cl.

| | |
|---|---|
| ***F21S 8/00*** | (2006.01) |
| ***F21V 13/00*** | (2006.01) |
| ***F21V 1/00*** | (2006.01) |
| ***F21S 4/00*** | (2016.01) |
| ***F21V 5/00*** | (2018.01) |
| ***F21V 7/00*** | (2006.01) |
| ***F21S 8/06*** | (2006.01) |
| ***F21V 11/16*** | (2006.01) |
| *F21Y 103/10* | (2016.01) |
| *F21Y 115/10* | (2016.01) |

(52) U.S. Cl.

CPC . *F21S 8/03* (2013.01); *F21S 8/06* (2013.01); *F21V 7/005* (2013.01); *F21V 7/0008* (2013.01); *F21V 11/16* (2013.01); *F21Y 2103/10* (2016.08); *F21Y 2115/10* (2016.08)

(58) Field of Classification Search

CPC . F21V 3/049; F21V 3/10; F21V 11/02; F21V 11/06; F21V 11/08; F21V 11/12; F21V 11/14; F21V 11/00; F21V 1/00; F21V 1/12; F21V 1/146; F21V 5/00; F21V 5/04; F21V 5/08; F21V 7/0008; F21V 7/005; F21V 7/05; F21V 17/06; F21Y 2103/10; F21S 8/046; F21S 8/04; F21S 8/043; F21S 8/06; F21S 8/061; F21S 8/063; F21S 8/03

USPC ..... 362/242, 243, 248

See application file for complete search history.

(56) References Cited

U.S. PATENT DOCUMENTS

| | | | | |
|---|---|---|---|---|
| 5,038,259 | A * | 8/1991 | Katoh | F21V 9/08 362/256 |
| 5,887,968 | A * | 3/1999 | Logan | G09F 13/14 362/240 |
| 6,231,212 | B1 * | 5/2001 | Cooney | F21S 8/04 362/256 |
| 6,467,934 | B1 * | 10/2002 | Holten | F21V 7/0016 359/852 |
| 7,205,719 | B2 * | 4/2007 | Tain | G02F 1/133603 313/11 |
| 7,490,969 | B2 * | 2/2009 | Sun | F21S 8/00 362/600 |

(Continued)

FOREIGN PATENT DOCUMENTS

WO WO 2015000864 A9 * 8/2015 ..... F21K 9/62

*Primary Examiner* — Erin Kryukova

(74) *Attorney, Agent, or Firm* — Banner & Witcoff, Ltd.

(57) ABSTRACT

A luminaire having a diffuser structure configured to adjust a shadow cast from one or more LED light sources such that the shadow cast has a gradated transition between an area of illumination and an area of shadow. Accordingly, diffuser teeth may be configured to cast a plurality of shadows from a plurality of LED light sources such that a complex overlap pattern of shadows from the plurality of LED light sources forms a shadow gradient between an area of illumination and an area in shade.

15 Claims, 14 Drawing Sheets

(56) References Cited

U.S. PATENT DOCUMENTS

| | | | | |
|---|---|---|---|---|
| 7,857,483 | B2 * | 12/2010 | Storch | F21K 9/00 362/247 |
| 2005/0047138 | A1 * | 3/2005 | Rochna | F21V 11/00 362/260 |
| 2005/0180132 | A1 * | 8/2005 | Chung | F21S 8/06 362/217.16 |
| 2006/0227003 | A1 * | 10/2006 | Ven | F21S 48/328 340/815.45 |
| 2006/0232960 | A1 * | 10/2006 | Pfund | F21S 8/033 362/223 |
| 2012/0063125 | A1 * | 3/2012 | Quaal | A47F 3/001 362/125 |
| 2013/0044479 | A1 * | 2/2013 | Jouffrieau | F21V 3/04 362/235 |
| 2014/0016315 | A1 * | 1/2014 | Yu | F21V 11/00 362/235 |
| 2016/0369972 | A1 * | 12/2016 | Thijssen | F21K 9/62 |

* cited by examiner

DIFFUSER FOR LUMINAIRE

FIELD OF THE INVENTION

The present invention relates to the field of luminaires, and in particular, luminaires having light-emitting diode (LED) light sources.

BACKGROUND

Light fixtures, or luminaires, may be configured with a variety of light source orientations and/or technologies, and utilized to achieve a variety of lighting effects. For example, a luminaire may be utilized to shine direct light into a living/working space. In another example, a luminaire may be utilized to shine indirect light into a living/working space by reflecting light off of one or more ceiling/wall/floor surfaces. Accordingly, luminaires having many different configurations exist, including, among others, downlights, recessed luminaires, linear light fixtures, and/or pendant light fixtures. In one example, one or more luminaire configurations may utilize fluorescent tube light sources, wherein, at least in part due to their widespread use, one or more lighting characteristics (color temperature, luminous flux, shadow characteristics, among others) of such fluorescent tube light sources may be desired of any alternative light source technologies.

In one example, light-emitting diode (LED) light sources may be utilized in a luminaire. Advantageously, LEDs offer increased energy efficiency when compared to fluorescent tube, incandescent, or other light source technologies. The light emitted by LED light sources may, however, be comparatively more directional than light emitted by fluorescent tube light sources. As a consequence, in one example, a shadow cast from an LED light source may have a comparatively more abrupt transition between an illuminated area, and an area of shadow. A fluorescent tube light source may, in contrast, cast a shadow having a comparatively more gradated transition between an illuminated area and an area of shadow. Accordingly, in some instances, it may be desirable for a luminaire utilizing LED light sources to emulate those shadow characteristics of a fluorescent tube light source (e.g. it may, for example, be more desirable for a consumer who is familiar with luminaires utilizing fluorescent tube light sources). As such, a need exists for improvements in luminaire design, including improvements in one or more mechanisms for altering an appearance of a shadow cast from a luminaire utilizing LED light sources.

BRIEF SUMMARY

The following presents a simplified summary of the present disclosure in order to provide a basic understanding of some aspects of the claimed subject matter. This summary is not an extensive overview of the claimed subject matter. It is not intended to identify key or critical elements of the claimed subject matter or to delineate the scope of the claimed subject matter. The following summary merely presents some concepts of the claimed subject matter in a simplified form as a prelude to a more detailed description provided below.

In one aspect, this disclosure relates to a luminaire having a housing that is coupled to a support surface, and such that the housing has an array of point light sources configured to emit light through an opening in the housing. Further, the housing has a diffuser structure with a non-linear edge structure, configured to set up a gradient between an illuminated area and a shadow cast from the light emitted from the plurality of point light sources.

In another aspect, this disclosure relates to a luminaire having a housing, the housing having an opening configured to emit light from a light source. A diffuser structure is coupled to the housing, and has a plurality of diffuser teeth configured to create a gradient between an illuminated area, and an area in shadow of the light emitted from the light source.

In yet another aspect, this disclosure relates to a luminaire having a housing configured to accommodate a first linear array of a first plurality of light sources, and a second linear array comprising a second plurality of light sources. The housing further accommodates a V-shaped linear diffuser structure, parallel to the first and the second linear arrays. Accordingly, the V-shaped linear diffuser structure has a plurality of diffuser teeth configured to create a gradient between an illuminated area and an area in shadow of the visible light emitted from the first and the second plurality of light sources.

BRIEF DESCRIPTION OF THE DRAWINGS

The present invention is illustrated by way of example and not limited in the accompanying figures in which like reference numerals indicate similar elements and in which.

DETAILED DESCRIPTION OF THE INVENTION

As discussed above, there is need for improved luminaire designs. Accordingly, various implementations of luminaires described herein may utilize multiple, connected components. As such, throughout this disclosure, it may be assumed that coupling, mounting, or joining of multiple components may be direct or indirect, and this disclosure is not intended to be limiting in this respect. It is noted that various components are described below as separate components. Two or more of these components may be combined to form a single component as appropriate, and this disclosure is not intended to be limiting in this respect.

In addition, various features are described below in greater detail. It should be noted that different combinations of these features may be combined as desired to generate luminaires with more or less features, depending on the features that are needed. Thus, it is envisioned that additional luminaires using combinations of the below described features are within the scope of the present invention.

Figure 1:
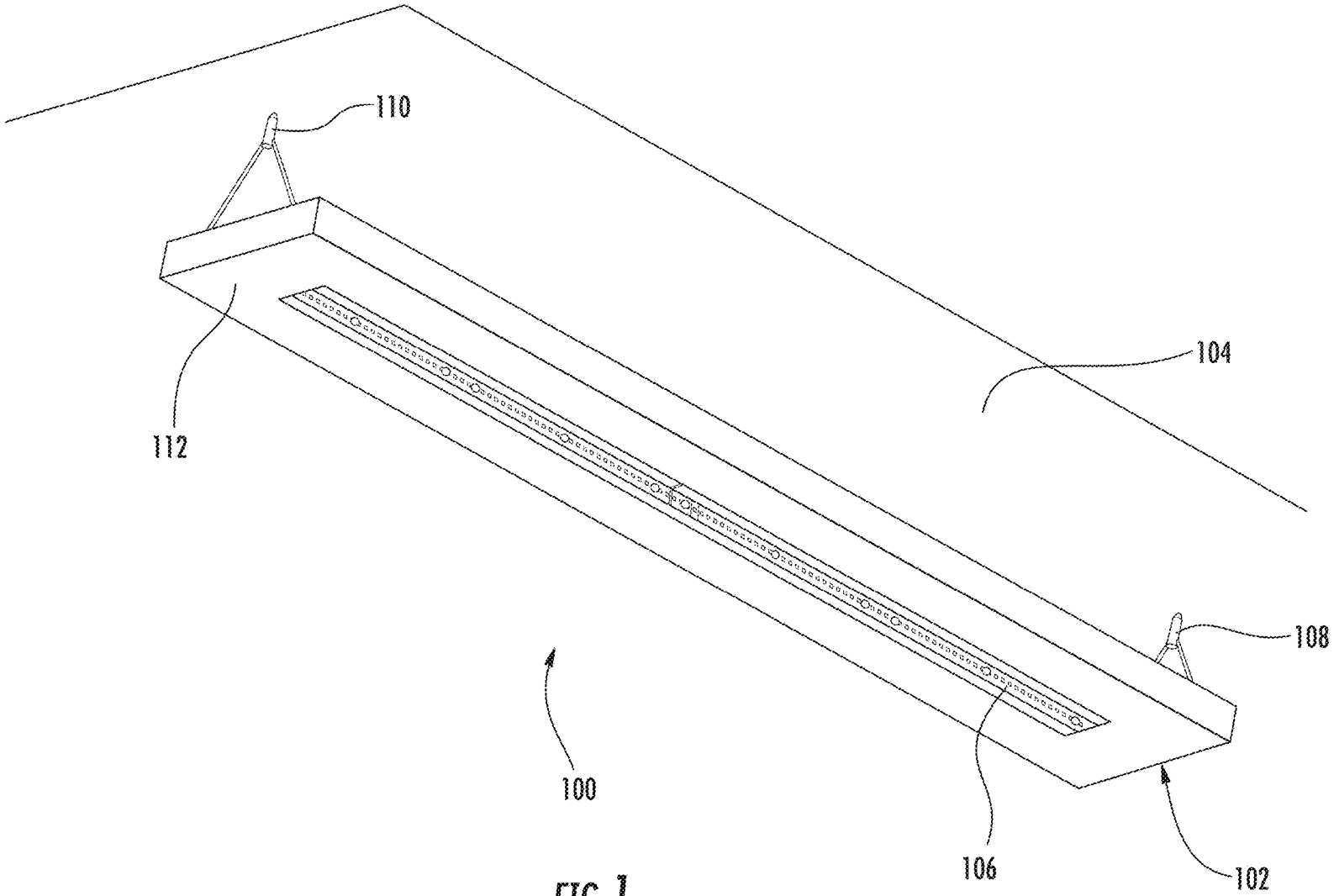
FIG. 1 illustrates a view of an embodiment of a luminaire.

In one implementation, the systems and methods described herein are directed towards one or more embodiments of a luminaire having a diffuser structure configured to adjust one or more lighting characteristics of a luminaire. FIG. 1 schematically depicts a one implementation of a luminaire 100. Accordingly, luminaire 100 further comprises a housing 102, and an opening 106. In one example, opening 106 may be configured to receive a transparent or translucent panel (not shown). As such, said panel may be configured to allow transmission of, and/or to diffuse, visible light. In one implementation, luminaire 100 may be coupled to a support surface 104 by support structures 108 and 110. In one implementation, support surface 104 may comprise one or more of a ceiling surface, a wall surface, and/or a floor surface, or combinations thereof. Additionally or alternatively, luminaire 100 may be configured to be positioned indoors or outdoors. Furthermore, in one example support structures 108 and 110 may comprise any coupling structures, including, among others, one or more brackets and/or one or more cables configured to couple luminaire 100 to support surface 104 such that there is a standoff gap/separation distance between luminaire 100 and support surface 104. In another implementation, luminaire 100 may be directly-coupled to support surface 104 such that no standoff distance exists between said luminaire 100 and said support surface 104. In yet another implementation, luminaire 100 may be recessed into a cavity in support surface 104 (not pictured). Additionally, it will be readily understood to those of ordinary skill in the art that support structures 108 and 110 are merely exemplary implementations, and that luminaire 100 may be coupled to support surface 104 by a single support structure, or a plurality of support structures in excess of those two support structures 108 and 110 depicted in FIG. 1.

In one example, luminaire 100 may comprise an elongated lighting fixture with a substantially rectangular shape. However, alternative implementations of luminaire 100 may be envisioned by those of ordinary skill in the art without departing from the scope of the disclosures described herein. For example, luminaire 100 may comprise a substantially square shape, or a substantially circular shape, among many others. In one implementation, one or more components of luminaire 100, or associated support structures 108 and 110, and the like, may comprise any material with mechanical properties capable of forming those components described herein. For example, one or more components of luminaire 100 may comprise a metal, a polymer, a fiber-reinforced material, a ceramic, or a wood, or combinations thereof. Additionally, one or more components of luminaire 100 may comprise one or more material coatings. For example, a structural component may comprise a polymer base structure having a metallized coating, and the like.

In one example, FIG. 1 schematically depicts luminaire 100 as viewed by a user once installed and coupled to a support surface 104. As such, in one implementation, the depicted view of luminaire 100 from FIG. 1 may be referred to as a "front" view, and surface 112 of housing 102 may be referred to as a front surface 112.

Figure 2A:
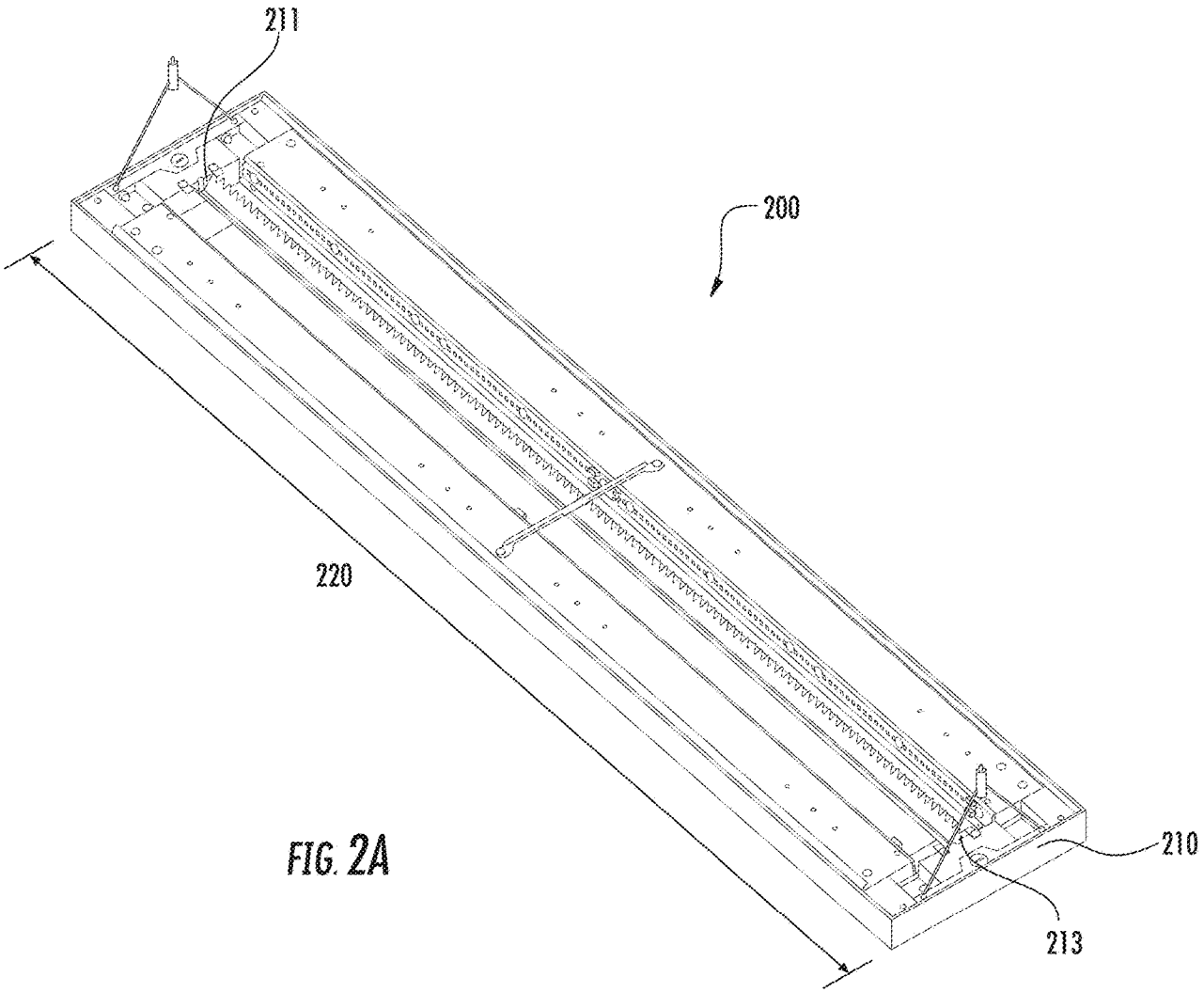
FIGS. 2A-2D illustrate alternative views of an embodiment of a luminaire.

FIG. 2A schematically depicts a "back view" of a luminaire 100. In one implementation, luminaire 100 comprises a substantially rectangular housing 102, however those of ordinary skill in the art will recognize that various alternative configurations of housing 102 may be utilized, without departing from the disclosures described herein. For example, housing 102 may be embodied with, among others, a substantially square, triangular, or circular shape, among others. In one implementation, the depicted elongated (rectangular) luminaire 100 has longitudinal length 220. In one implementation, longitudinal length 220 may be embodied with any dimensional value, without departing from the scope of the disclosures described herein.

Figure 2B:
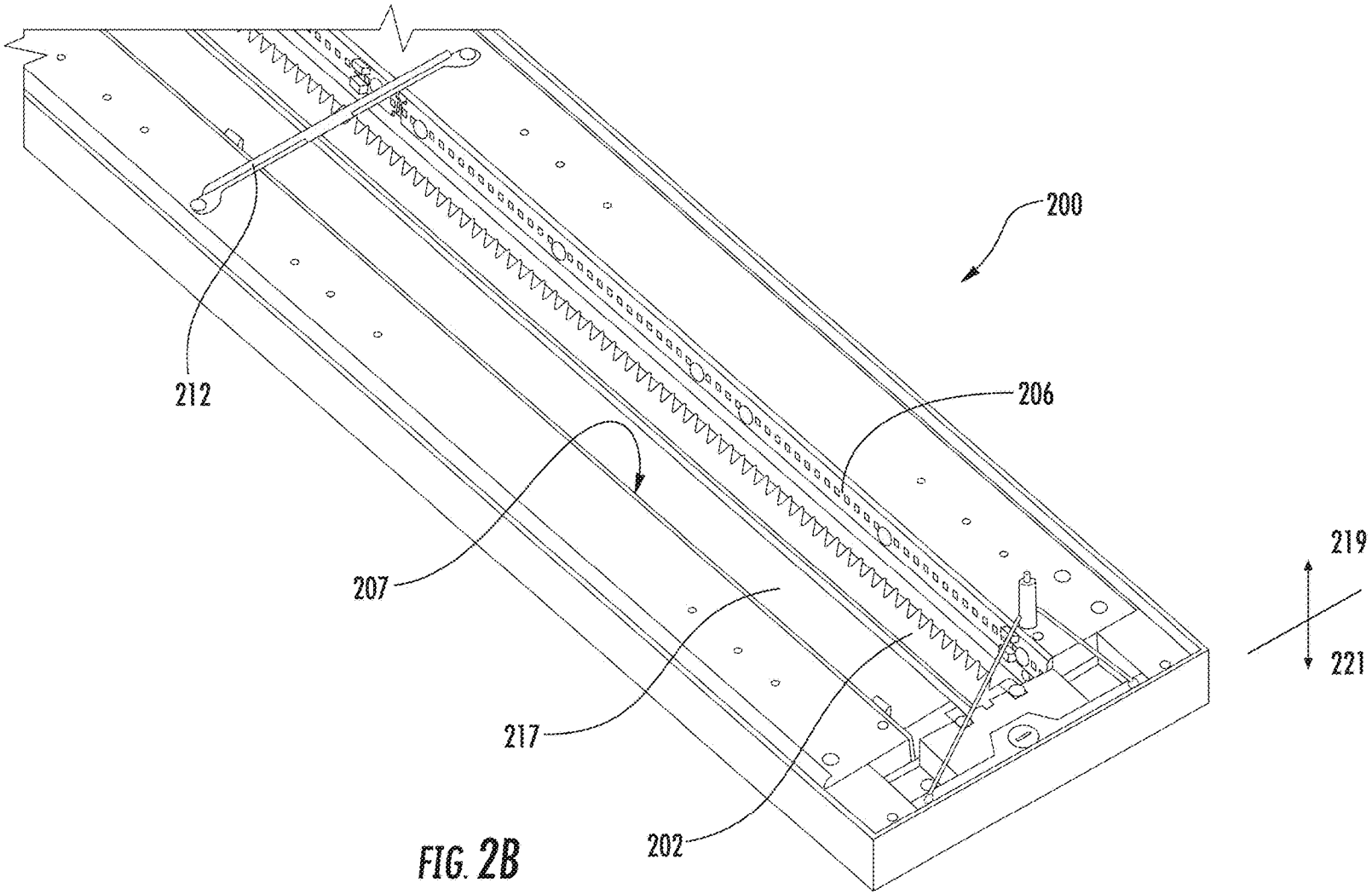
Figure 2C:
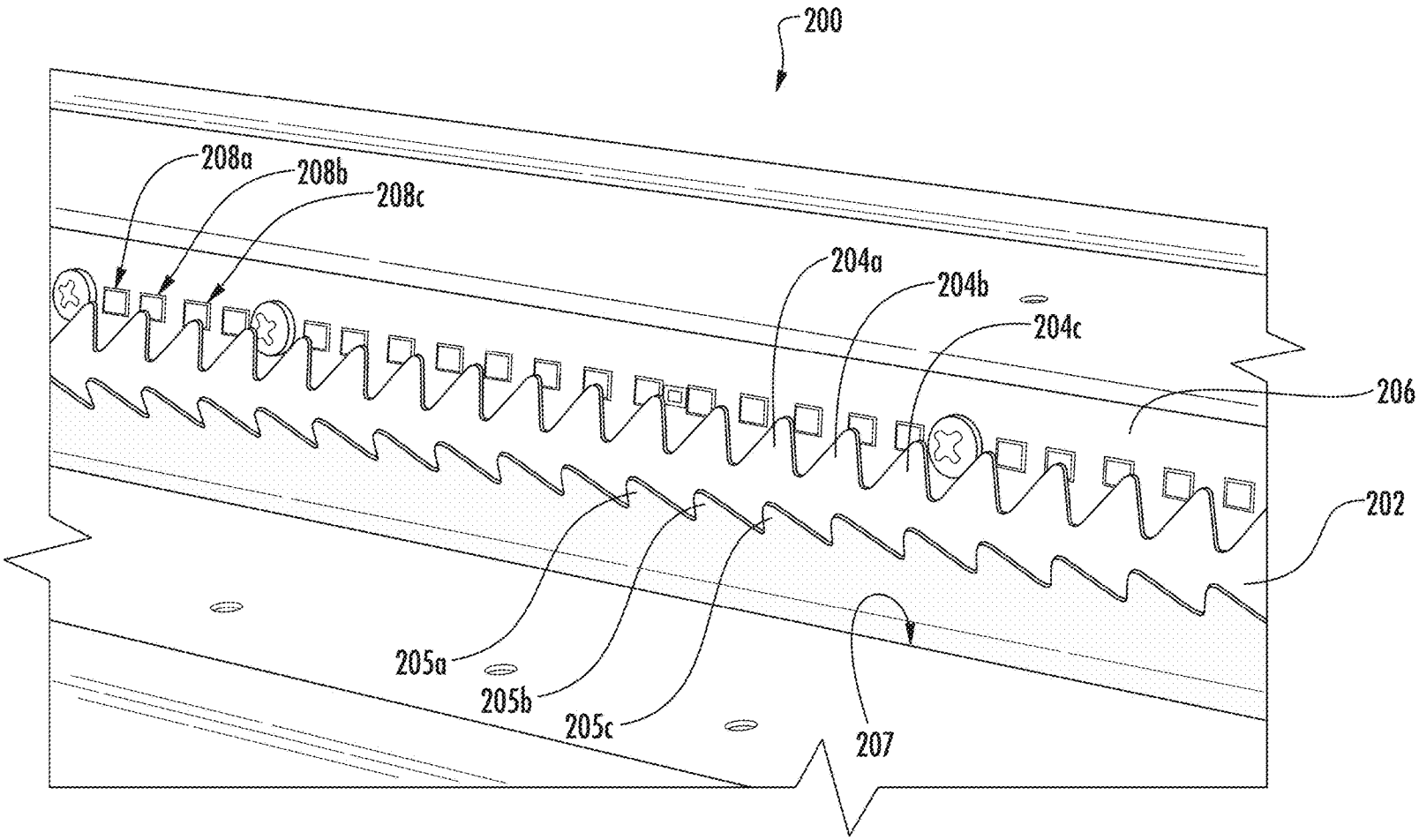

FIGS. 2B and 2C depict detailed views of portions of luminaire 100. In particular, FIG. 2B depicts luminaire 100 as having a first light source array 206 spaced apart from a second light source array 207. Accordingly, in one implementation, diffuser structure 202 is spaced between the first light source array 206 and the second light source array 207. In one example, luminaire 100 may utilize one or more point light sources 208*a*-208*c*, and may include the diffuser structure 202 to adjust a lighting transition between an area illuminated by luminaire 100, and an area in shadow. As such, diffuser structure 202, as described herein, may create a gradated transition between an area of illumination and an area of shadow. The diffuser structure 202 may alternatively be referred to as a diffuser "comb," wherein said diffuser comb may comprise a plurality of diffuser teeth, such as teeth 204*a*-204*c* and 205*a*-205*c*. It should be understood that the depicted diffuser structure is one example of a diffuser structure, and various additional/alternative implementations are described in throughout the disclosure.

In one example, the diffuser teeth 204*a*-204*c* and 205*a*-205*c* may be configured to cast a plurality of shadows from a plurality of point light sources, such as sources 208*a*-208*c*, and such that a complex overlap pattern of shadows from the plurality of light sources forms a shadow gradient between an area of illumination and an area in shadow. Advantageously, this diffuser structure 202 may be utilized to improve a luminous efficacy (ratio of the luminous flux to power) (lm/W) when compared to a luminaire (not shown) that utilizes a diffuser screen to cover opening 217, and the like. Additionally, other potential benefits will become clear after a further review of the disclosure provided below.

As depicted in FIG. 2C, the first light source array 206 may be substantially parallel to the second light source array 207. In one example, light source array 206 comprises a linear array having a plurality of light sources. As such, light sources 208*a*-208*c* are exemplary point light sources that make up the light source array 206. In one example, light sources 208*a*-208*c* may comprise light-emitting diodes (LEDs). In another example, luminaire 100 may comprise one or more light source technologies in addition to, or as an alternative to, light source arrays 206 and 207. As such, luminaire 100 may include, among others, fluorescent light sources, or incandescent bulb light sources, or combinations thereof. Additionally, luminaire 100 may comprise light sources of any power rating, or any luminous flux rating.

Figure 2D:
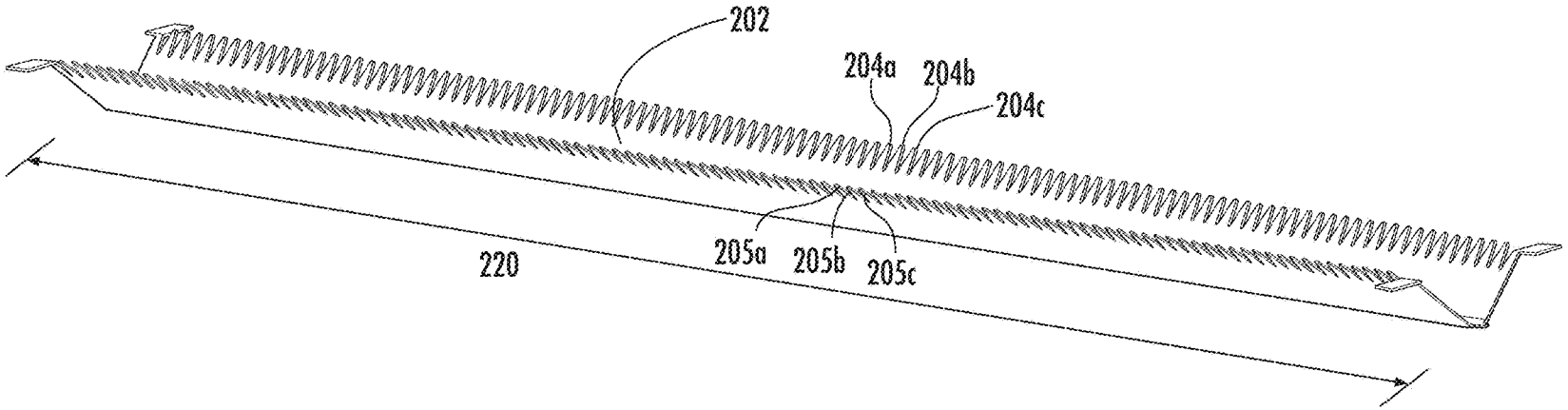

In one example, diffuser structure 202 spans the longitudinal length 220 of luminaire housing 102. Accordingly FIG. 2D schematically depicts an isometric view of the diffuser structure 202 removed from the luminaire 100. As depicted in FIG. 2B, diffuser 202, may be spaced between the first light source array 206 and the second light source array 207. Accordingly, in one implementation, opaque diffuser 202 may be coupled to housing 102 at a first end 211 and a second end 213 (depicted in FIG. 2A). Additionally, and as depicted in FIG. 2B, opaque diffuser structure 202 may be rigidly coupled to housing 102 by one or more support arms 212. In particular, the support arm 212 may be utilized to prevent/reduce flexing of the diffuser structure 202 along the longitudinal length 220, and such that a correct alignment between the diffuser teeth, such as teeth 204*a*-204*c* and 205*a*-205*c*, and the light sources, such as light sources 208*l*-208*c*, may be maintained. In this way, a desired overlapping shadow pattern cast by the diffuser teeth may be maintained.

Figure 9:
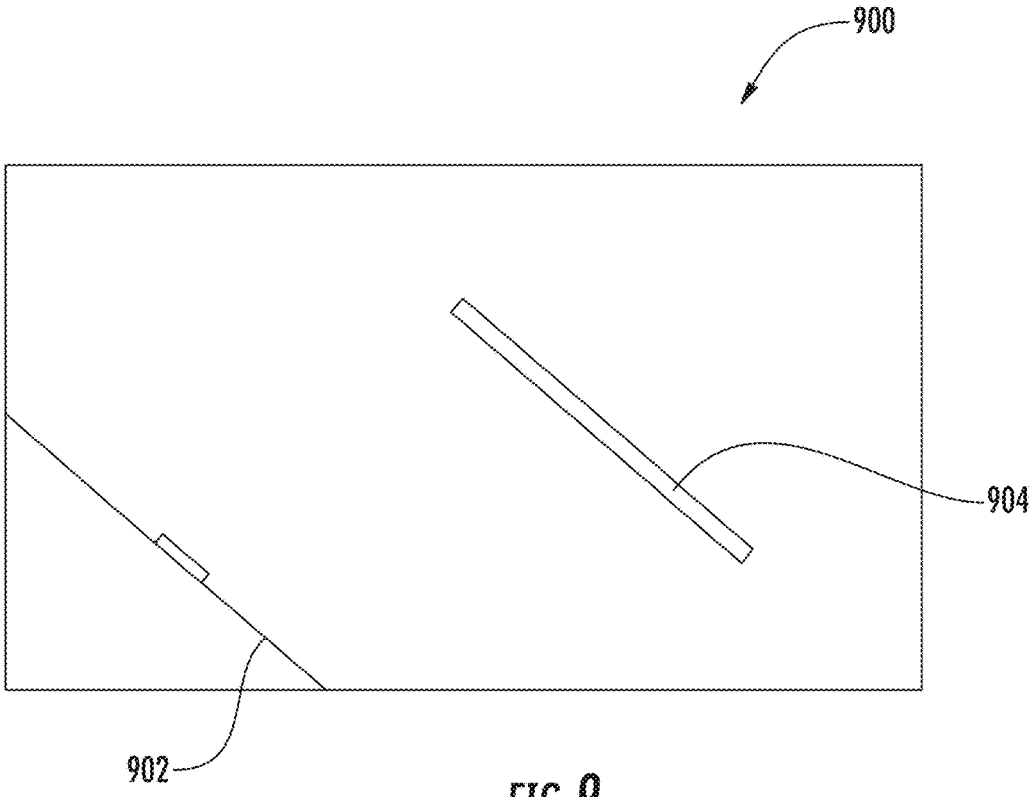
FIG. 9 schematically depicts a cross-sectional view of an alternative implementation of a luminaire according to one or more aspects described herein.

In one implementation, and as shown in FIG. 2D, diffuser 202 may comprise a substantially V-shaped structure (channel) with a first plurality of diffuser teeth, such as, for example, exemplary diffuser teeth 204*a*-204*c*, and a second plurality of diffuser teeth, such as, for example, exemplary diffuser teeth 205*a*-205*c*. However, those of ordinary skill in the art will recognize that alternative luminaire and diffuser implementations may be realized without departing from the disclosures described herein. For example, FIG. 9 schematically depicts a cross-sectional view of a luminaire 900 having a single light source array 902. In this way, light source array 902 may be similar to arrays 206 and 207. As such, luminaire 900 may comprise a planar diffuser structure 904 (as opposed to the substantially V-shaped structure of diffuser 202), and configured to create a pattern of overlapping shadows from one or more diffuser teeth (similar in functionality and/or geometries to teeth 204*a*-204*c* and 205*a*-205*c*). Additionally, the luminaires of the present invention may be mounted to the wall in various embodiments without departing from this invention.

Figure 10:
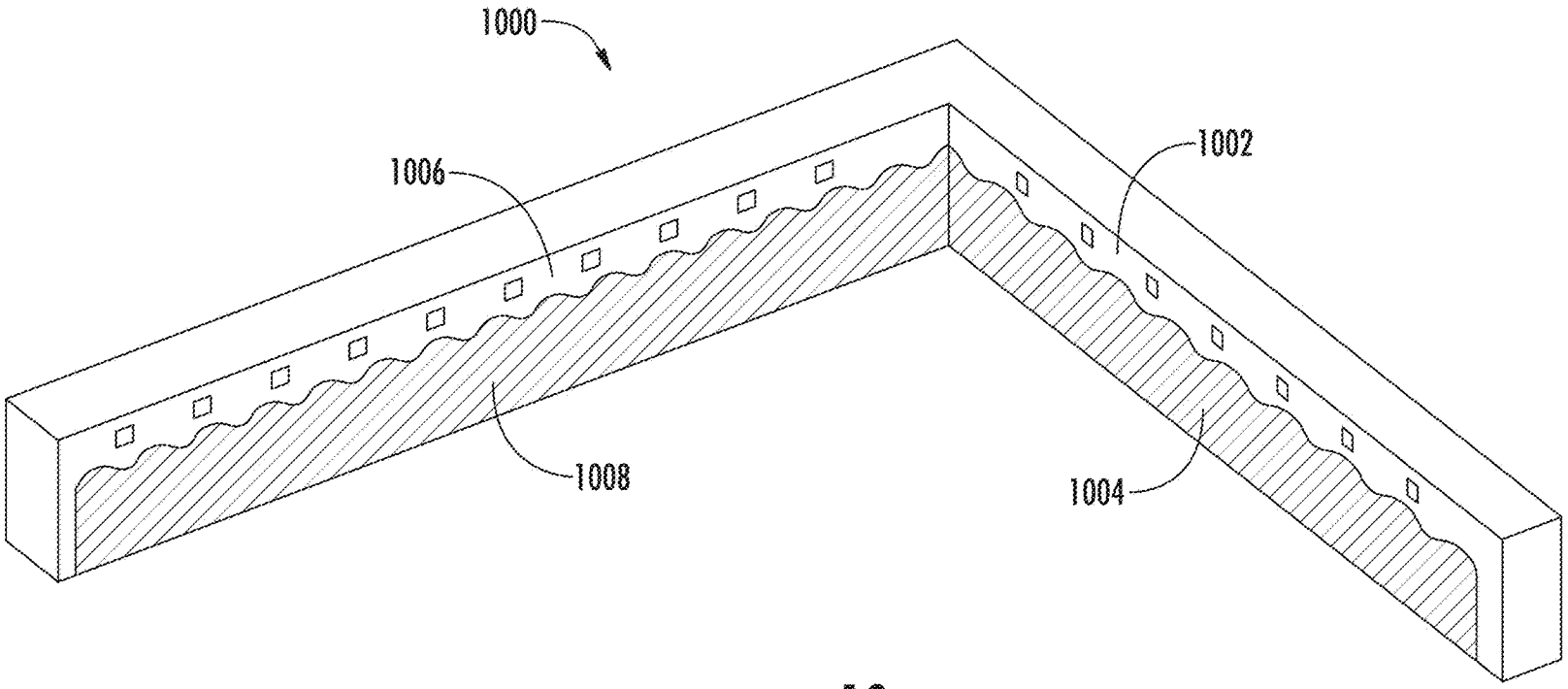
FIG. 10 schematically depicts a view of an alternative implementation of a luminaire according to one or more aspects described herein.

In another implementation, and as depicted in FIG. 10, a luminaire 1000 may comprise one or more light source arrays that are not parallel to one another. For example, luminaire 1000 may comprise a first light source array 1002, similar to one or more of arrays 206 and 207, which is not parallel to a second light source array 1006, similar to one or more of arrays 206 and 207. As such, in one example, a relative angle between arrays 1002 and 1006 may have any value. In one specific example, a first light source array 1002 may be perpendicular to a second light source array 1006. Accordingly, the first light source array 206 may be configured to cast an overlapping shadow pattern from a first diffuser 1004, and the second light source array 1006 may be configured to cast an overlapping shadow pattern from a second diffuser 1008. Furthermore, in one example, the described diffuser structure may be utilized with a luminaire having one or more curved structures (not shown). For example, a luminaire may comprise a curved light source array, and a corresponding diffuser structure may have a similarly-curved shape, or may comprise a planar structure with diffuser teeth of differing sizes configured according to the curvature of the curved light source array.

In one implementation, luminaire 100 is configured to emit a luminous flux from light source arrays 206 and 207 through an opening 217. In one example, a first portion of light emitted from light source arrays 206 and 207 is substantially along direction 219, and a second portion of light emitted from light source arrays 206 and 207 is substantially along direction 221. In one example, when light from one or more of the light source arrays 206 and/or 207 is incident upon the diffuser structure 202, a complex overlapping shadow pattern is cast from luminaire 100 such that a shadow gradient is set up between an illuminated area and an area in shadow. Accordingly, the ratio of the number of light sources (e.g. light sources 208*a*-208*c* etc.) to the number of diffuser teeth (e.g. 204*a*-204*c*) (light source-to-diffuser teeth ratio) may be a fixed ratio, or may be a range of ratios. For example, the light source-to-diffuser teeth ratio may be, 1.2:1, 1.1:1, 1:1, 1:1.1, 1:1.5, 1:2, or range between 0.5 and 2.5, among others. In another example, opaque diffuser 202 may be utilized with any ratio of light sources to diffuser teeth. In one implementation, a number of diffuser teeth may equal the number of light sources. In another implementation, a number of diffuser teeth may be greater than or less than a number of light sources. The geometries of the diffuser teeth (such as diffuser teeth 204*a*-204*c*) and light sources (such as light sources 208*a*-208*c*) are described in further detail in relation to FIGS. 7 and 8.

Additionally, diffuser 202 may be utilized with one or more light sources comprising a plurality of sub-components for light emission. As such, where FIGS. 2A-2D depict light source arrays 206 and 207 as having a plurality of discrete light sources (for example, light sources 208*a*-208*c*), opaque diffuser 202 may alternatively be utilized with a light source comprising a continuous element for light emission. This may be the case, for example, if a diffuser element is positioned over those light sources 208*a*-208*c* to give the appearance of one continuous light-emitting element. In another example, an opaque diffuser 202 may be utilized with a single elongated light-emitting element. For example, opaque diffuser 202 may be utilized with an elongated contiguous light-emitting diode element (not shown).

Figure 3:
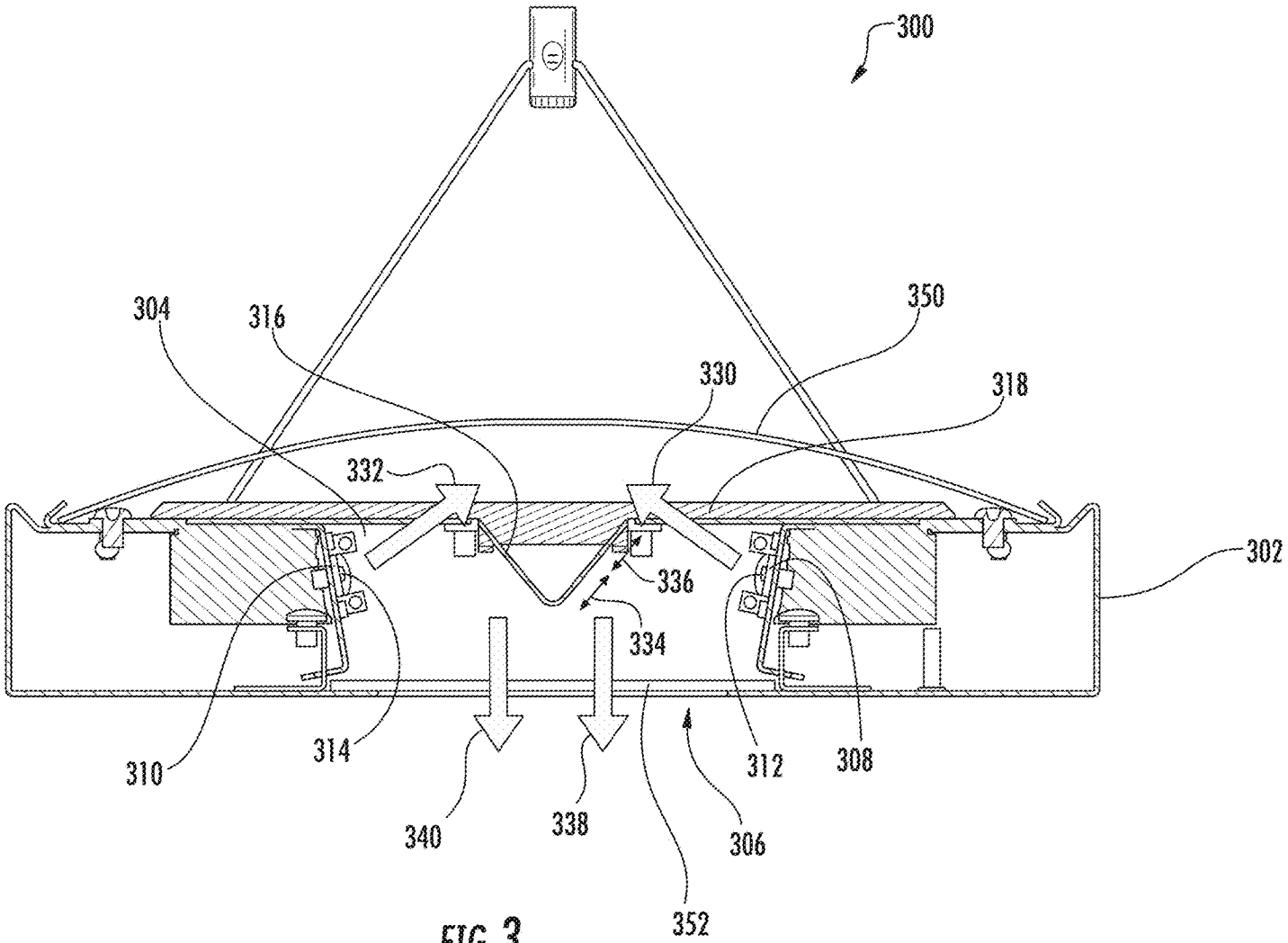
FIG. 3 illustrates a cross-sectional view of an exemplary embodiment of a luminaire.

FIG. 3 schematically depicts a cross-sectional view of luminaire 100. In one implementation, the first opening 217 may be covered by panel (not shown), wherein this may be planar, or curved, and may be partially or wholly transparent/translucent to visible light. Similarly, the second opening 106 may be covered by a panel 352, wherein panel 352 may also be partially or wholly transparent/translucent to visible light. In one example, a substantially V-shaped opaque diffuser structure 202 may be coupled to the housing 102 by support arms 318. In one implementation, a first linear array of light sources 206 and a second linear array of light sources 207 may be coupled to housing 102, wherein light source 312 is an exemplary light source of the plurality of light sources associated with the first linear array 206, and light source 314 is an exemplary light source from the plurality of light sources associated with linear array 207.

In one implementation, a luminous flux from light source 312 (representative of a luminous flux from a plurality of light sources that make up the linear array 206) is emitted along that direction represented by arrow 330. In one implementation, arrow 330 is merely representative of a general direction along which light is emitted from light source 312. Accordingly, it will be readily understood that light emitted from light source 312 may spread out from the point of emission in a conical shape, a spherical shape, or a lambertian shape, among others, and such that the emitted light may not be a focused beam of light. In another implementation, one or more light sources 312 from light source array 206 may be partially or wholly focused, and the like. Similarly, light emitted from light source 314 may travel along a general direction indicated by arrow 332.

In one example, a first portion of the light emitted from light source 312 may travel out through the first opening 217. A second portion of the light emitted from light source 312 may be incident upon one or more diffuser teeth (element 336) of opaque diffuser 202. Accordingly, a plurality of overlapping shadows may be cast from opaque diffuser 202 along direction 330. Additionally, a third portion of light emitted from light source 312 may reflect off of one or more surfaces (such as, for example, surfaces 334 and/or 336) of opaque diffuser 202, including those surfaces that make up one or more diffuser teeth. Accordingly, in one example, a third portion of light emitted from light source 312 may be reflected out of the second opening 106 along the direction indicated by arrow 338. Similarly, a first portion of the light emitted substantially along direction 332 from light source 314 may travel out through opening 217 and a second portion of light may be reflected out through the second opening 106 along a direction indicated by arrow 340.

Accordingly, in one example, approximately 70% of light from linear arrays 206 and 207 may be emitted through the first opening 217, and approximately 30% of the light may be emitted through the second opening 106. In another example, approximately 80% of the light from linear arrays 206 and 207 is emitted through the first opening 217, approximately 20% of the light emitted from linear array 206 and 207 may be emitted through the second opening 106. In one example the relative percentages of light emitted through opening 217 and 106 may vary based upon, among others, the size and geometry of diffuser 202, the color (reflectivity) and/or opacity of diffuser 202, the color (light absorption/reflectivity properties) of one or more components that make up luminaire 100, and an angle of the orientation of linear arrays 206 and 207 (discussed in relation to FIG. 4).

Advantageously, luminaire 100 is configured to have a comparatively higher luminous efficacy (ratio of the luminous flux to power) (lm/W) to those luminaires that may utilize light source technologies other than light-emitting diodes, and/or diffuser components other than that diffuser 202 described herein. For example, a transparent diffuser gel/film/window, when utilized on a luminaire (not shown), may result in a lower luminous efficacy for said luminaire when compared to than that of luminaire 100, and the like. In one implementation, luminaire 100 may be utilized to emit light in the visible spectrum with any luminous efficacy, without departing from the disclosures described herein.

Figure 4:
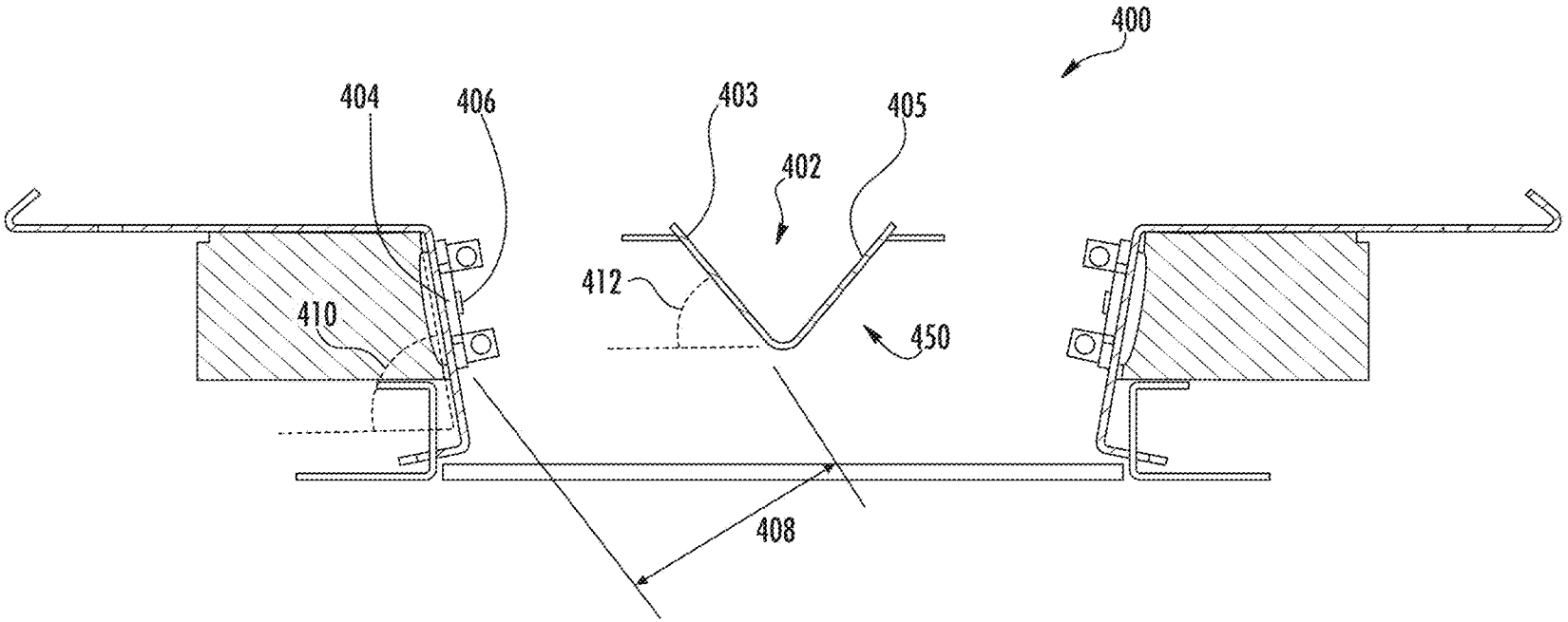
FIG. 4 schematically depicts another cross-sectional view of a luminaire according to one or more aspects described herein.

FIG. 4 schematically depicts a cross-sectional view of a luminaire 100. In particular, FIG. 4 depicts one exemplary geometrical relationship between a diffuser structure 202 and a light source 406, wherein light source 406 may be part of a linear array of light sources 207. Diffuser 202 may comprise a first diffuser arm 403 having a planar structure comprising a plurality of diffuser teeth, similar to diffuser teeth 205*a*-205*c* and 208*a*-208*c* from FIG. 2. Furthermore, the substantially V-shaped channel of diffuser 202 may have a second diffuser arm 405, wherein the second diffuser arm 405 may be substantially symmetrical to diffuser arm 403, and the like. As previously described, diffuser 202 may be utilized to adjust a shadow cast from one or more light sources, wherein light source 406 may represent a plurality of LED light sources spaced apart along a linear array 207.

In one example, linear array 207 may be angled relative to the horizontal plane at an angle 410. Accordingly, diffuser 202, which may have a substantially V-shaped configuration similar to diffuser 202, may be angled at an angle 412. In one example, angles 410 and 412 are equal to one another such that a plane that includes linear array 207 is parallel to a plane of the first plurality of diffuser teeth associated with the first diffuser arm 403. In another example, angles 410 and 412 may not be equal to one another, and the like. In one example, angle 410 may be embodied with a value ranging between approximately 5° and approximately 180°. In one example, angle 410 may be adjustable between a first angle and a second angle. In one implementation, angle 412 may have a value that ranges between approximately 0° and approximately 359°, among others. In one implementation, diffuser 202, and specifically, the first diffuser arm 403, may be spaced apart from linear array 207 by a linear distance 408. In one example, distance 408 may be embodied with any dimensional value. Additionally, and as described in further detail in relation to FIG. 6, one or more geometries of 207 may change relative to one another and/or be scaled based upon the relative distance 408 between the light source array 207 and the first diffuser arm 403.

FIG. 4 further depicts the light source array 207 having at least one axis parallel to at least one axis of diffuser arms 403 and 405 (along longitudinal length 220). However, in alternative embodiments of luminaire 100 may be utilized such that there are no parallel axes between diffuser 202 and light source arrays 206 and/or 207.

Figure 5:
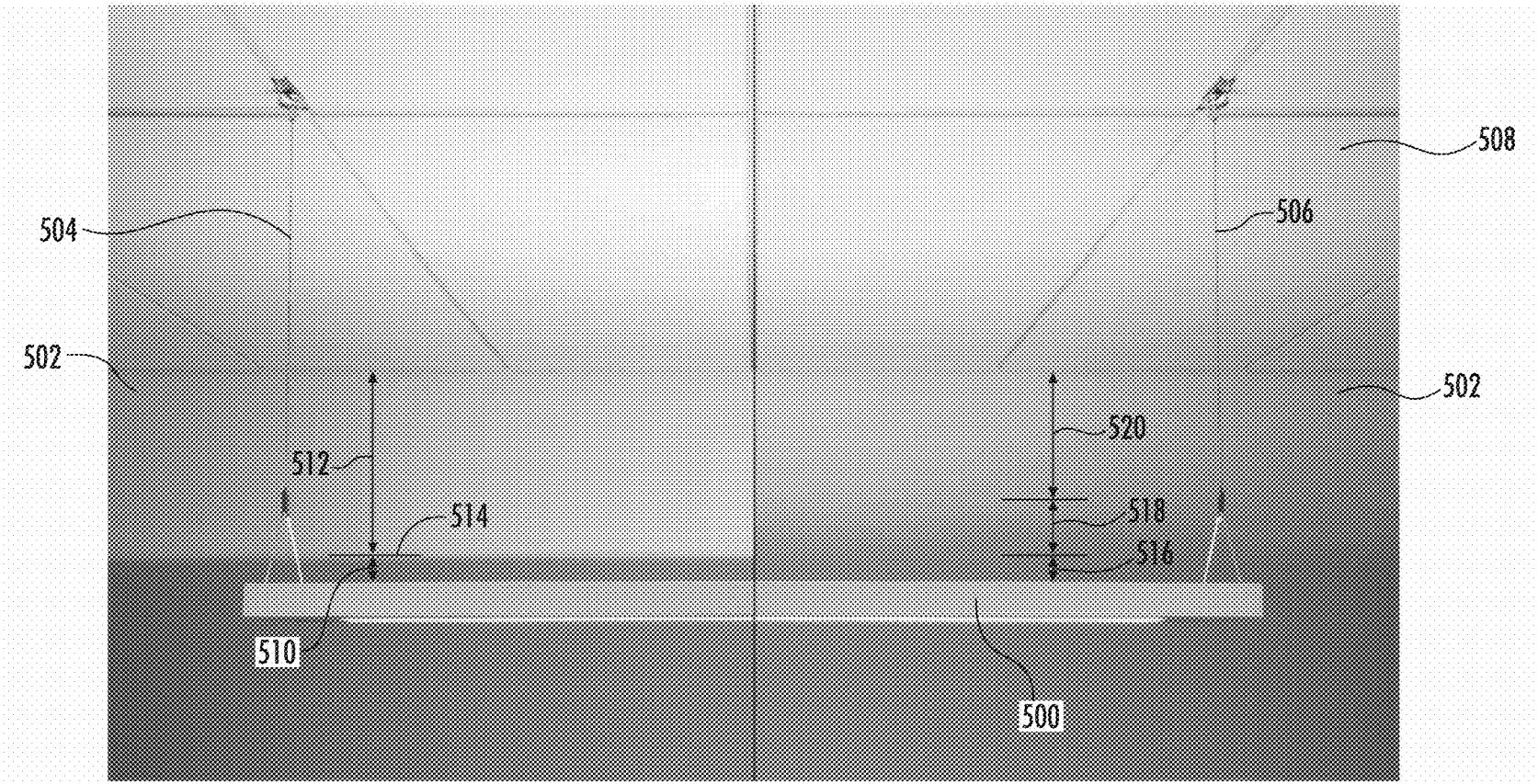
FIG. 5 schematically illustrates shadows cast from a luminaire according to one or more aspects described herein.

FIG. 5 is a composite of two images of luminaire 100 in-use. The left half of FIG. 5 depicts luminaire 100 without a diffuser structure, such as diffuser 202. The right half of FIG. 5 depicts the same luminaire 100, but the luminaire 100 in the right half of FIG. 5 has been configured to include a diffuser, such as diffuser 202, (not pictured in FIG. 5). Both the left and right halves of FIG. 5 depict luminaire 100 as operational, e.g. powered on and emitting light from one or more arrays of light sources, such as light source arrays 206 and 207. (not pictured). Accordingly, FIG. 5 serves to illustrate one or more advantageous effects produced by the described opaque diffuser 202, when utilized in a luminaire, such as luminaire 100.

In particular, the composite of two images that make up FIG. 5 depict a luminaire 100, coupled to a ceiling structure 508 by two support structures 504 and 506. Accordingly, the left half of FIG. 5 (that having luminaire 100 without a diffuser) depicts a sharp interface (e.g. along interface line 514) between an area in shadow (schematically illustrated as that area along length 510) and an illuminated area (schematically illustrated as that area along length 512), and such that that the illuminated area (associated with length 512) and area in shadow (associated with length 510) are cast on a wall surface 502.

The right half of FIG. 5 (that half depicted as utilizing a diffuser structure), depicts the light cast from luminaire 100 as having a gradient area 518 between an area in shadow 516 and an illuminated area 520. Accordingly, as will be apparent to those of skill in the art, the relative and absolute sizes of those areas represented by lengths 510, 512, 516, 518, and 520 may vary based upon, among others, the size of the luminaire 100, the distance of wall surface 502 from the luminaire 100, the size and geometry of the diffuser structure 202 utilized in that image on the right half of FIG. 5, the number and power rating of the light sources utilized in luminaire 100, or combinations thereof.

Figure 6:
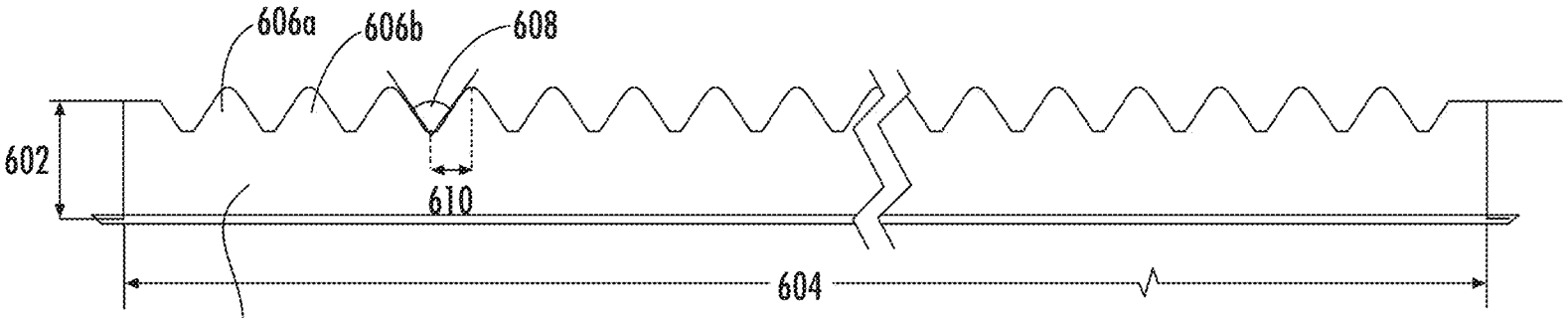
FIG. 6 schematically depicts one implementation of a diffuser structure.

FIG. 6 schematically depicts one implementation of a diffuser structure 600. In one example, a diffuser structure 600 may be similar to one or more of diffuser structures 202 and/or 904. In one example, diffuser structure 600 may be opaque. In another example, diffuser structure 600 may be partially transparent. In one example, diffuser 600 may be referred to as a diffuser comb 600. In particular, opaque diffuser 600 comprises a plurality of triangular (rounded-triangular) teeth, wherein teeth 606*a* and 606*b* are exemplary teeth from the plurality of teeth that make up diffuser 600. In one example, FIG. 6 represents a view of diffuser 202 from FIG. 4 as viewed along that direction indicated by arrow 450. Accordingly, in one implementation, teeth 606*a* and 606*b* are in a common plane. In one example, the diffuser has a height 602 and a longitudinal length 604. In one implementation, height 602 and length 604 make have any values.

In one implementation, a diffuser tooth, such as tooth 606*a* or 606*b*, has a length 610 and an angle 608. In one example, the dimensional values of elements 602, 604, 608, and 610 may have any value, and may scale in proportion, or disproportionately, from one another.

In one example one or more teeth 606*a* and/or 606*b* of diffuser structure 600 may be co-planar. In another example, one or more teeth 606*a* and/or 606*b* of diffuser structure 600 may be configured to be in different planes. In one example, the exemplary teeth 606*a* and 606*b* of diffuser 600 may have similar geometries. However, in another example, diffuser 600 may be embodied with tooth geometries that differ across length 604 of diffuser 600. Furthermore, a plurality of diffuser sub-structures/geometrical shapes (such as teeth 606*a* and 606*b*) that make up diffuser 600 may have pseudo-random, non-uniform geometries, in order to establish that gradient area 518 between an area in shadow 516 and an illuminated area 520. Accordingly, diffuser structure 600 may be embodied with a non-linear edge structure in order to achieve that gradient area 518.

Figure 7A:
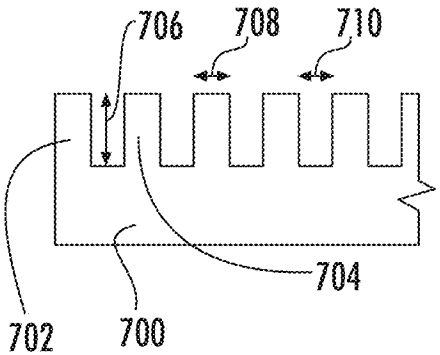
FIGS. 7A-7J schematically depict alternative implementations of diffuser structures according to one or more aspects described herein.
Figure 7B:
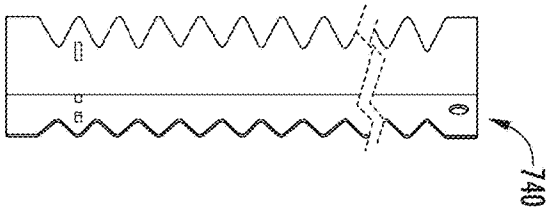

FIG. 7A schematically depicts an additional implementation of a diffuser structure 700. In particular, diffuser structure 700, otherwise referred to as a diffuser comb 700, may comprise a plurality of diffuser teeth, and such that diffuser teeth 702 and 704 are exemplary teeth from a plurality of teeth. In one implementation, diffuser structure 700 may comprise diffuser teeth having a plurality of different tooth geometries. In one example, diffuser structure 700 comprises a plurality of teeth having a substantially rectangular shape. In another example, diffuser structure 700 may comprise substantially square teeth, substantially circular teeth, substantially ellipsoidal teeth, oval teeth, curvilinear triangular teeth, trapezoidal teeth, trapezium-shaped teeth, sine-wave shaped teeth (or another wave pattern) (See FIG. 7B), or any geometry suitable for adjusting a shadow cast from a light source as described in relation to FIG. 5.

In one example, a diffuser tooth, such as tooth 702 and/or 704, may have a height 706 and a width 708. Further, a pair of adjacent teeth, selected from the plurality of teeth that make up diffuser structure 700, may be separated by a tooth separation distance 710. In one implementation, any height 706, width 708, and separation distance 710 may be utilized, without departing from the disclosures described herein. Furthermore, a first tooth, such as tooth 702, may have a different geometry to a second tooth, such as tooth 704, and the like. Additionally or alternatively, one or more of a plurality of teeth of diffuser structure 700 may each have pseudo-random geometries relative to one another.

Figure 7C:
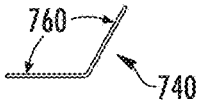
Figure 7D:
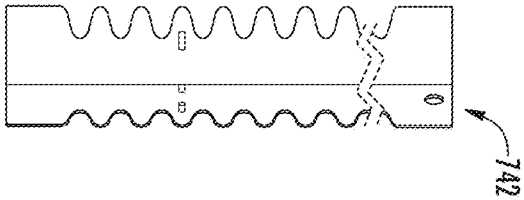
Figure 7E:
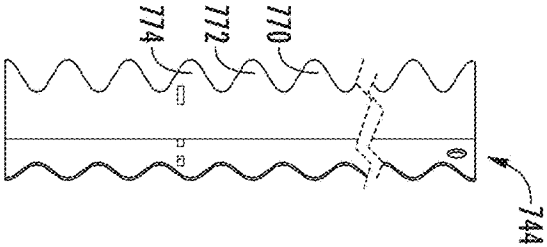
Figure 7F:
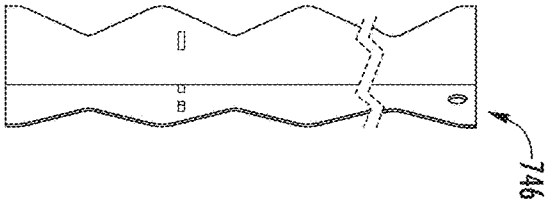
Figure 7G:
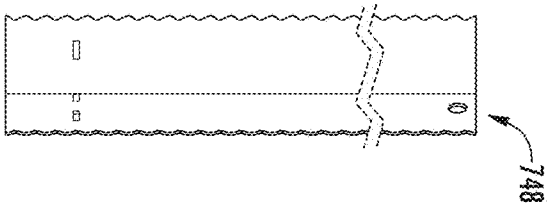
Figure 7H:
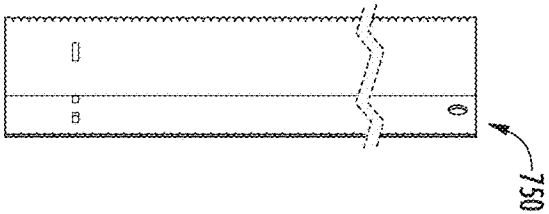
Figure 7I:
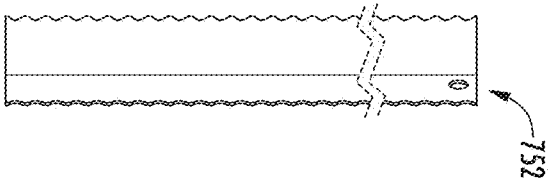

FIGS. 7B-7I schematically depict alternative implementations of a diffuser structure. For example, a diffuser structure, similar to diffuser structure 600 or 700, may be embodied with saw-tooth geometry, or with a substantially sinusoidal wave-like geometry having a plurality of peaks, such as exemplary peaks 770-774 in FIG. 7E. In one example, FIG. 7C schematically depicts an elevation view of the diffuser structure 740 depicted in a plan view in FIG. 7B. Accordingly, in one implementation, diffuser structure 740 may be configured with an angle 760. In one example, angle 760 may equal to approximately 120°. In another example, angle 760 may range from approximately 5° to 180°.

In one example, diffuser structures 740-752 depicted in FIGS. 7B-7I may have substantially opaque structures. In another example, a diffuser structure, from diffuser structures 740-752 may be a partially transparent structure. Accordingly, one or more of the diffuser structures 740-752 may comprise a metal, a polymer, a fiber-reinforced material, wood, a ceramic, or any other material that may be utilized to form the described structure.

In one implementation, the substantially wave-like geometry of diffuser structure 744 comprises a plurality of peaks (e.g. peaks 770-774). As such, the wave-like pattern of diffuser structure 744 may be configured with any frequency and amplitude, or additional geometric features.

Figure 7J:
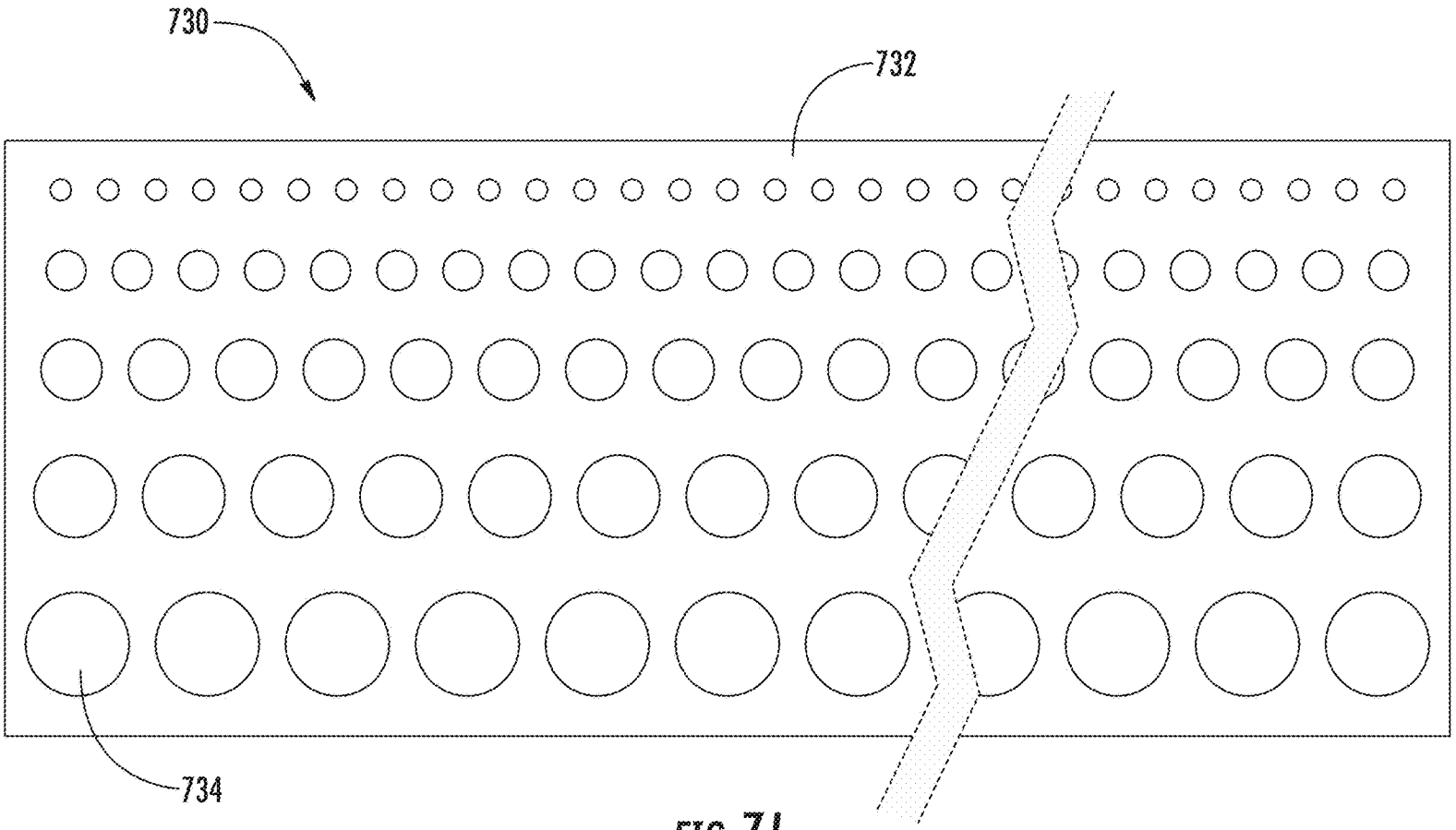

FIG. 7J schematically depicts yet another implementation of a diffuser structure 730. In one example, diffuser structure 730 may comprise a transparent, or partially-transparent base structure 732 having a pattern 734 with a comparatively higher opacity positioned thereon. Accordingly, pattern 734 may be configured to project a plurality of overlapping shadows, and to generate a gradated transition similar to area 518 from FIG. 5. Accordingly, pattern 734 may comprise any pattern type, including a plurality of circular shapes, square shapes, or any other geometric shape and/or pattern. In one implementation, pattern 734 may comprise geometries of any size, without departing from the scope of the disclosures described herein. In one example, diffuser structure 730 may comprise a transparent polymer or glass base structure 732 and a printed pattern 734, and the like. In one implementation, the pattern 734 may be manufactured by processes other than printing, such as deposition processes, or any other processes known to those of skill in the art. In one example, the pattern 734 may comprise a reflective surface.

Figure 8:
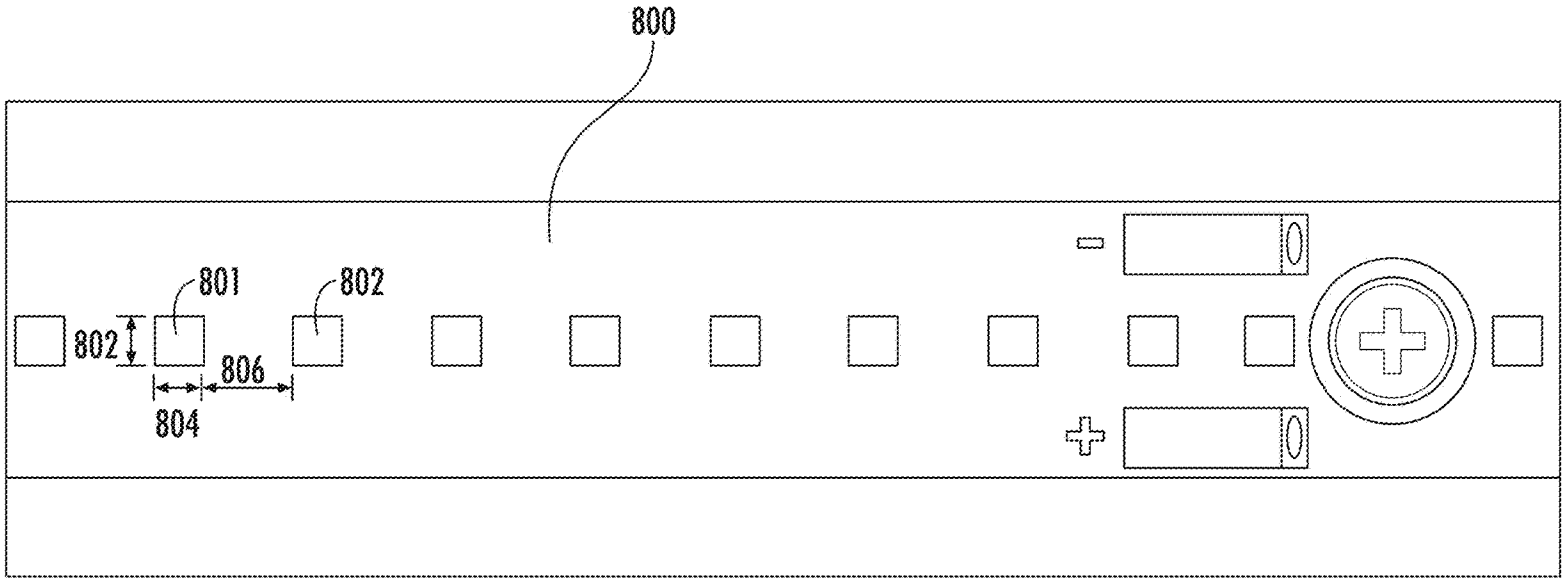
FIG. 8 schematically depicts a light source array according to one or more aspects described herein.

FIG. 8 schematically depicts a light source array 800. In particular, array 800 may be similar to one or more of arrays 206 and/or 207. In one example, light source array 800 may comprise a plurality of point light sources. As such, point light sources 801 and 802 may be exemplary point light sources from a plurality of light sources. In one specific example point light sources 801 and/or 802 may be LED light sources. Those of ordinary skill in the art will recognize that any LED technologies may be utilized with the disclosures herein without departing from the described embodiments. Accordingly, a light source, such as light source 801, may have a substantially rectangular shape, a substantially square shape, a substantially circular shape, or any other suitable geometry. In one example, a light source, such as light source 801, may have a height 802, a width 804, and may be separated from an adjacent light source 803 by a separation distance 806. As such, those of ordinary skill in the art will recognize that dimensions 802, 804, and/or 806 may be embodied with any dimensional values, without departing from the scope of the disclosures described herein. In one example, and as schematically depicted in FIG. 8, a plurality of point light sources, such as sources 801 and 802, may be arranged in a linear (1-dimensional) array. However, those of ordinary skill in the art will recognize that array 800 may comprise a plurality of point light sources arranged along two axes (2-dimensional array). In one example, a separation between light sources that make up array 800 may be uniform. In another example, a separation distance between light sources may be non-uniform. Accordingly, in one example, an array of light sources that make up array 800 may be configured in a 1-dimension or 2-dimensional grid, or may be positioned randomly.

In yet another implementation, a spacing of a plurality of light sources on light source array 800 may be configured (randomized) such that luminaire 100 may be utilized to create gradient area 518 without using a diffuser structure 202. In this way, a spacing of a plurality of light sources may be configured to emit an light to create a transition (area 518) between an illuminated area 520 and a shaded area 516.

It is noted that, as used herein, the term "approximately" may indicate a value ranging by plus or minus (+/−) 20% from an indicated value, and the like.

The present invention has been described in terms of preferred and exemplary embodiments thereof. Numerous other embodiments, modifications and variations within the scope and spirit of the appended claims will occur to persons of ordinary skill in the art from a review of this disclosure.

We claim:

1. A luminaire comprising:

a housing configured to be coupled to a support surface;

an array comprising a plurality of point light sources within the housing, said plurality of point light sources spaced apart along a length of the housing, wherein the plurality of point light sources are configured to emit light through an opening in the housing, the array including a first linear array of light sources on a first surface of the housing and a second linear array of light sources on a second surface of the housing; and a linear diffuser structure coupled to the housing between the first and second linear arrays of light sources, the diffuser structure having a V-shaped channel with a plurality of diffuser teeth having a uniform saw-tooth geometry, wherein the diffuser structure is parallel to the array, wherein the plurality of diffuser teeth are configured to create a gradient between an illuminated area and an area in shadow of the light emitted from the plurality of point light sources.

2. The luminaire of claim 1, wherein the plurality of point light sources are light emitting diodes (LEDs).

3. The luminaire of claim 1, wherein the diffuser structure is opaque to visible light.

4. The luminaire of claim 1, wherein the opening in the housing is a first opening configured to emit a first portion of the light and the housing further comprises a second opening configured to emit a second portion of the light.

5. A luminaire comprising:

a housing having an opening;

a first linear array of light sources on a first surface of the housing;

a second linear array of light sources on a second surface of the housing; and a linear diffuser structure coupled to the housing between the first and second linear arrays of light sources, the diffuser structure having a V-shaped channel with a first plurality of diffuser teeth on a first surface and a second plurality of diffuser teeth on a second surface, wherein the diffuser structure is parallel to the first and second linear arrays of light sources, and wherein the first plurality of diffuser teeth and the second plurality of diffuser teeth are configured to create a gradient between an illuminated area and an area in shadow of the light emitted from the first and second linear arrays of light sources.

6. The luminaire of claim 5, wherein the first linear array of light sources and the second linear array of light sources comprise a plurality of light emitting diodes (LEDs).

7. The luminaire of claim 6, wherein the plurality of diffuser teeth are spaced apart along a common plane, parallel to the first linear array and the second linear array.

8. The luminaire of claim 5, wherein a first diffuser tooth, selected from the first plurality of diffuser teeth, has a first shape, and a second diffuser tooth, selected from the second plurality of diffuser teeth, has a second shape, different from the first shape.

9. The luminaire of claim 5, wherein the first plurality of diffuser teeth and the second plurality of diffuser teeth have a uniform saw-tooth geometry.

10. The luminaire of claim 5, wherein the diffuser structure is opaque to visible light.

11. A luminaire comprising:

a housing configured to be coupled to a support surface, said housing having an opening;

a first linear array comprising a first plurality of light sources on a first surface of the housing;

a second linear array comprising a second plurality of light sources on a second surface of the housing, wherein the first and the second linear arrays are configured to emit visible light through the opening;

a linear diffuser structure coupled to the housing between the first and second linear arrays, the diffuser structure having a V-shaped channel with a first plurality of diffuser teeth on a first surface and a second plurality of diffuser teeth on a second surface, wherein the diffuser structure is parallel to the first linear array and the second linear array, and wherein the first plurality of diffuser teeth and the second plurality of diffuser teeth are configured to create a gradient between an illuminated area and an area in shadow of the visible light emitted from the first and the second plurality of light sources.

12. The luminaire of claim 11, wherein the first surface of the diffuser structure and the second surface of the diffuser structure are angled relative to a plane comprising the opening in the housing.

13. The luminaire of claim 11, wherein the first plurality of light sources and the second plurality of light sources are light-emitting diodes (LEDs).

14. The luminaire of claim 11, wherein the first plurality of diffuser teeth and the second plurality of diffuser teeth have a uniform saw-tooth geometry.

15. The luminaire of claim 11, wherein the diffuser structure is opaque to visible light.

* * * * *